United States Patent [19]

Zinn

[11] Patent Number: 4,941,838

[45] Date of Patent: Jul. 17, 1990

[54] ELECTRIC PLUG AND SOCKET CONNECTOR

[75] Inventor: Bernd Zinn, Ennepetal, Fed. Rep. of Germany

[73] Assignee: Grote & Hartmann GmbH & Co. KG, Fed. Rep. of Germany

[21] Appl. No.: 277,140

[22] Filed: Nov. 29, 1988

[30] Foreign Application Priority Data

Nov. 30, 1987 [DE] Fed. Rep. of Germany ..... 3740580

[51] Int. Cl.[5] ..... H01R 13/627

[52] U.S. Cl. ..... 439/350; 439/358; 439/352

[58] Field of Search ..... 439/350–358, 439/567, 552, 555, 557, 833, 839

[56] References Cited

U.S. PATENT DOCUMENTS 1,835,251 12/1931 Welstein ..... 439/358
2,194,769 3/1940 Reed ..... 439/358
3,544,951 12/1970 Roberts ..... 439/358
4,718,857 1/1988 Noschese ..... 439/358

*Primary Examiner*—David Pirlot
*Attorney, Agent, or Firm*—Jones, Askew & Lunsford

[57] ABSTRACT

This invention concerns a lockable electric plug and socket connector with a plug enclosure with compartments for several plug contact elements and a mating plug enclosure with compartments for several mating plug contact elements as well as a snap action locking device for locking the two enclosures that have catch noses on the plug enclosure and a U-shaped spring clip mounted on the enclosure so it acts together with the catch noses and a catch edge on the mating plug enclosure so the catch noses can lock behind it, and it has an operating tab that acts on the spring clip to unlock the enclosures, the spring clip (16) is a metal part punched from sheet metal and placed on edge so it acts on a toggle lever (7), and the catch noses (10) are located on the toggle lever.

10 Claims, 2 Drawing Sheets

ELECTRIC PLUG AND SOCKET CONNECTOR

This invention concerns an interlocking electric plug and socket connector with a plug enclosure with compartments for several plug contact elements and a mating connector enclosure with compartments for several mating connection contact elements and with an interlocking device for locking the two enclosures with catches on the plug enclosure and a U-shaped spring clip mounted on the plug enclosure so it works together with the catches and with a catch edge for the catch to lock behind and with an operating tab that works together with the spring clip to unlock the connector.

Such a plug and socket connector is known from German Pat. No. 3,150,424. The spring clip here consists of a spring wire and is positioned in a plane at right angles to the plug direction. To unlock the connector, the spring clip must be moved so it is spread by expanding diagonal parts. A great force must be expended to unlock the connector because substantial frictional forces must be overcome. Furthermore, there is the danger that the ends of the spring arms may become jammed in unlocking and persist in the unlocked state so the locking device is then no longer functional. Furthermore, production of the spring clip requires an expensive bending operation, especially since the ends of the spring arms must have a special shape.

A locking device with a plug and socket connector of the type according to this invention is known from European Pat. No. 214,617 where the locking device likewise operates with a U-shaped spring clip. The spring clip is mounted on the plug enclosure in a plane parallel to the plug direction but it has an extraordinarily complicated shape at the ends of the clip arms which must be created by means of a very complicated bending manipulation. The ends of the clip arms form a toggle lever that can be operated manually to unlock the connector. The force required to unlock the connector by applying the toggle lever is very great because of the short lever arms. Furthermore, the path required of the toggle lever to unlock the connector is not limited in a defined manner so the unlocking position can be discerned.

The problem on which this invention is based is to create a plug and socket connector that will have a simple design and a locking device that is easy to unlock. This invention will now be explained in greater detail below on the basis of an example with reference to the figures which show the following.

Figure 1:
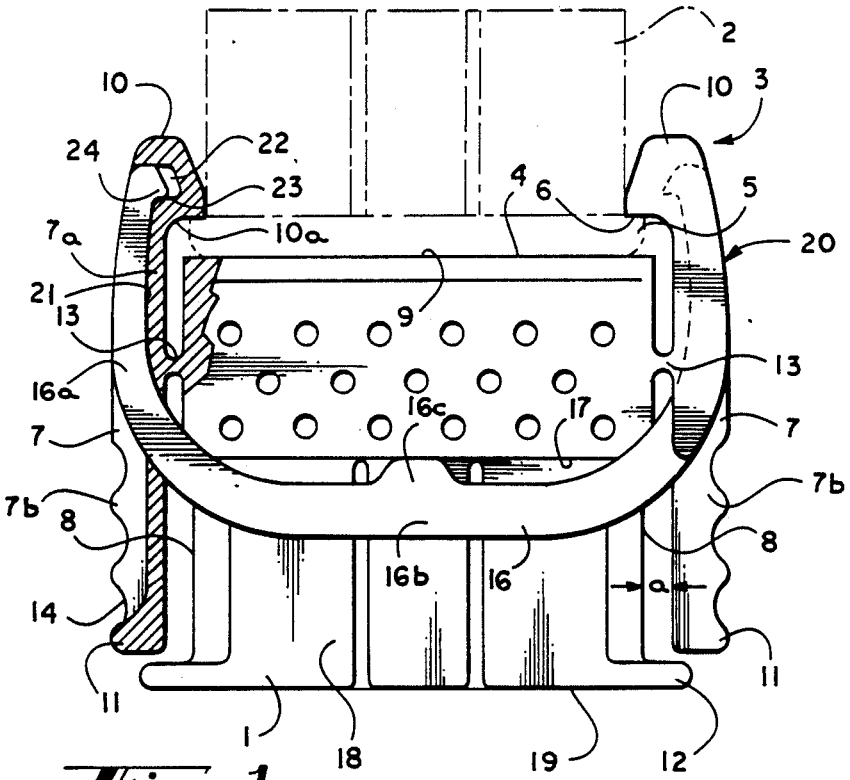
FIG. 1 shows a side view of the plug and socket connector, partially in sectional view.
Figure 3:
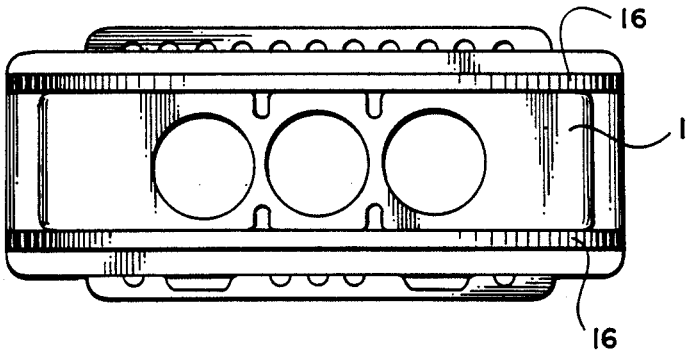
FIG. 3 shows a bottom view of the plug enclosure.
Figure 2:
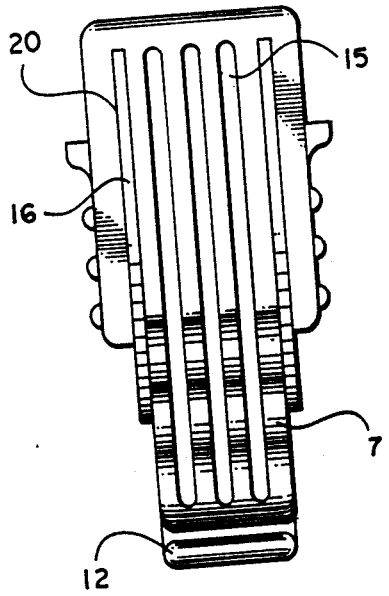
FIG. 2 shows a front view of the plug enclosure.

The plug and socket connector illustrated here is made of plastic and consists of plug enclosure 1 and mating plug enclosure 2. Only the outer contours of enclosures 1 and 2 are shown in detail because the locking device 3 is provided on the outside of the enclosures. The internal structure of the enclosure can conform to the conventional designs. The compartments are adapted to the shape of the contact and mating contact elements as well as the desired distribution in space.

The essentially box-shaped mating plug enclosure 2 has a bulge 5 in the area of the mating plug front 4 with a catch edge 6 that runs at right angles to the plug direction for locking device 3.

The other elements of locking device 3 are provided on plug enclosure 1 which is likewise essentially box shaped. These other locking elements have two identical toggle levers 7, one of which is located on each front side 8 of plug enclosure 1. The width of toggle lever 7 corresponds approximately to the width of the front side 8. The levers, however, are somewhat longer than the front sides 8 and project beyond the plug front 9 with catch noses 10. The end 11 opposite catches 10 ends just above a lower bulge 12 on plug enclosure 1.

Toggle levers 7 are located a distance a away from the front sides 8 of plug enclosure 1 and are connected in one piece to plug enclosure 1 by means of one crosspiece 13 each. Crosspiece 13 forms the toggle mount of toggle lever 7 and is located approximately in the middle of the toggle lever longitudinally so the toggle lever is subdivided into a catch lever arm **7*a* and an unlocking lever arm 7*b* which forms the unlocking tab. In order to increase the ease with which the unlocking tab can be gripped, transverse grooves 14 are provided in the exterior surfaces of the unlocking tab. Furthermore, longitudinal grooves 15 may also be provided in toggle lever 7** to reduce the weight of the lever.

Catch lever arm **7*a* ends with catch 10 which is aligned with a catch edge 10*a* toward enclosure 1 and projects beyond plug front 9. Catch end 10*a* locks behind catch edge 6 of bulge 5 of the mating plug enclosure 2 when plugs 1 and 2** are locked together.

Toggle lever 7 is loaded with two U-shaped spring clips 16. It is important that each spring clip 16 is a punched sheet metal part which is produced by simply punching it out of a sheet of metal. The punched sheet metal part is mounted so it is placed on edge and has spring arms **16*a* and base piece 16*b*. To mount base piece 16*b*, a bearing nose 16*c* that projects toward the interior of the U is provided in the middle of the base piece longitudinally and locks under a bearing edge 17 that runs across the plug direction and is provided on the longitudinal side 18 of plug enclosure 1 and is preferably in contact with the longitudinal side 18, so bearing edge 17 is located in a plane between the plane of transverse webs 13 and the bottom 19 of plug enclosure 1**.

Spring arms **16*a* are mounted in catch lever arms 7*a*. For this purpose, catch lever arms 7*a* have longitudinal grooves 20 worked from the outside and a groove bottom 21 Longitudinal grooves 20 extend from the area of transverse webs 13 up to the catch noses 10 and end in a catch recess 22 facing toward catch edge 10*a* with a catch step 23**.

Spring arms **16*a* have a catch nose 24 facing the interior of the U on the free end and locking behind catch step 23. Spring arms 16*a* sit with a form fitting connection and/or with a press fit in the bearing grooves 20 and rest on groove bottom 21**.

When tabs **7*b* are pressed on both sides against front sides 8, catch lever arms 7*a* pivot outward and catches edges 10*a* release bulge 5. Enclosures 1 and 2** are thus unlocked and can be pulled apart.

Spring 16 which has been stood on edge creates a high spring force acting on catch spring arms **7*a*. Due to the relatively great length of the unlocking lever arms 7*b***, the pivoting movement and thus the unlocking action can be achieved against the spring force with a relatively minor expenditure of force.

Figure 5:
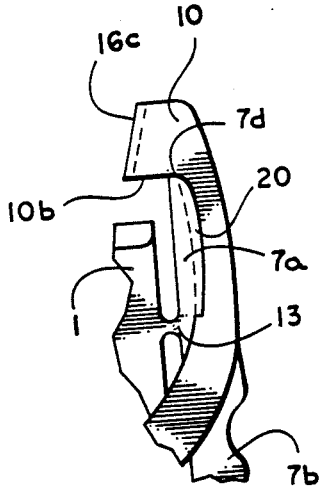
FIG. 5 shows part of the plug enclosure with a different version of the locking device.
Figure 4:
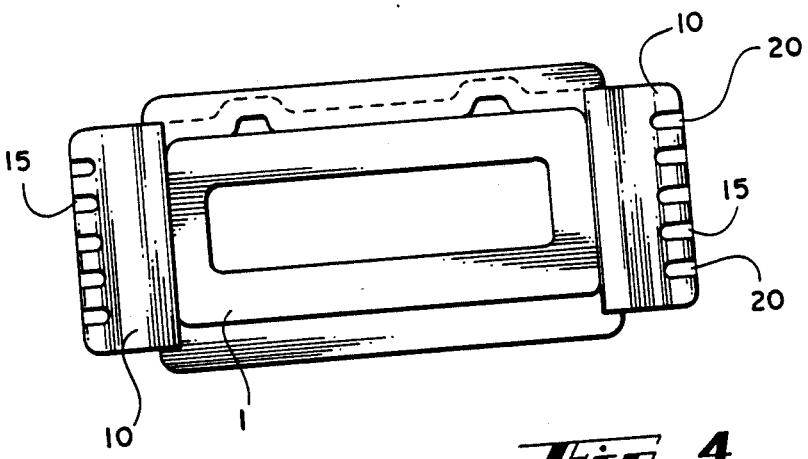
FIG. 4 shows a top view of the plug enclosure.

The version illustrated in FIG. 5 differs from that shown in FIGS. 1 to 4 in that the catch edge 10*b* is formed from the end area of spring arms 16*a*. Catch lever arms 7*a* end in front of catch noses 10 so the catch edge 10*b* projects above the upper edge 7*d* of catch lever arms 7*a*. Preferably the catch edge 10*b* ends in an edge piece 16*c* bent at a right angle toward the opposite spring 16, thus forming a catch edge that is longer than the thickness of the plate metal of the spring 16.

The locking device according to this invention requires simple shapes that are easy to manufacture with regard to the plastic parts as well as the springs. High spring forces and thus high locking forces can be assured but they can be overcome with low opposing spring forces resulting from the toggle lever arrangement.

I claim:

1. In a lockable electric plug and socket connector with a plug enclosure with compartments for several plug contact elements and a mating plug enclosure with compartments for several mating plug contact elements as well as a snap action locking device for locking the two enclosures with catch noses on the plug enclosure and a U-shaped spring clip mounted on the plug enclosure for cooperation with the catch noses, and a catch edge on the mating plug enclosure so the catch noses can lock behind the catch edge, and with an unlocking tab that acts on the spring clip to unlock the enclosures, the improvement comprising:

two toggle levers provided and formed in one piece on the front sides of the plug enclosure;

the spring clip is a sheet metal part punched from sheet metal and placed on its edge so the spring clip acts on a toggle lever to urge the toggle levers to a locked position, and the catch noses are located on the toggle lever;

the plug enclosure having front sides and the plug having a front characterized in that the width of each toggle lever corresponds approximately to the width of the front sides;

each toggle lever is somewhat longer than the front sides and has a catch noise projecting over the plug front so that the end of the toggle lever opposite the catch noses ends just above a base bulge formed on the plug enclosure opposite the front thereof; and the toggle levers are positioned a distance away from the front sides of the plug enclosure and are each connected to the plug enclosure by a crosspiece which forms the mount of the toggle lever and is located approximately in the middle of the toggle lever in the longitudinal direction, so the toggle lever is subdivided into a catch lever arm and an unlocking lever arm which forms the unlocking tab.

2. Plug and socket connector according to claim 1 characterized in that the unlocking tab has transverse grooves providing gripping surfaces to increase the ease with which the unlocking tab may be gripped.

3. Plug and socket connector according to claim 2, characterized in that longitudinal grooves 15 are provided in the toggle lever.

4. Plug and socket connector according to claim 1, characterized in that the catch lever arm ends with a catch nose which is aligned with a catch edge in the direction of the plug enclosure and projects over the plug front so that the catch edge locks behind the catch edge of a bulge associated with the mating plug.

5. Plug and socket connector according to claim 4, characterized in that each toggle lever is loaded with two U-shaped spring clips, where each spring clip is mounted on edge, has spring arms and a base piece, and a bearing nose that projects toward the interior of the U is provided in the middle of the base piece longitudinally for mounting the base piece, and the bearing nose is under a bearing edge that extends across the plug direction and is located on the longitudinal side of the plug enclosure and is preferably in contact with the longitudinal side, and the bearing edge is located in a plane between the plane in which the crosspieces are located and a bottom of the plug enclosure.

6. Plug and socket connector according to claim 5, characterized in that the spring arms are mounted in the catch lever arms.

7. Plug and socket connector according to claim 6, characterized in that the catch lever arms have longitudinal grooves cut from the outside and have a groove bottom, the longitudinal grooves extend from the area of the crosspieces up to the catch noses and end with a catch step in a catch recess facing toward the catch edge, and the spring arms have a catch nose facing the inside of the U on the free end so the catch nose can lock behind the catch step.

8. Plug and socket connector according to claim 7, characterized in that the spring arms sit snugly in bearing grooves with a form fit and/or a press and rest on the groove bottom.

9. Plug and socket connector according to claim 5, characterized in that a catch edge is formed by an end area of the spring arms, and the catch lever arms end before the catch noses so the catch edge projects above upper edges of the catch lever arms.

10. Plug and socket connector according to claim 9, characterized in that the catch edge ends in an edge piece that is bent at a right angle toward the opposite spring clip.

* * * * *

UNITED STATES PATENT AND TRADEMARK OFFICE

CERTIFICATE OF CORRECTION

PATENT NO. : 4,941,838

DATED : July 17, 1990

INVENTOR(S) : Bernd Zinn

It is certified that error appears in the above-identified patent and that said Letters Patent is hereby corrected as shown below:

Column 4, line 44 (Claim 8, line 3), cancel "with a form fit and/or a press".

Signed and Sealed this

Thirty-first Day of December, 1991

*Attest:*

HARRY F. MANBECK, JR.

*Attesting Officer*

*Commissioner of Patents and Trademarks*